US005577608A

United States Patent [19]

Hanson et al.

[11] Patent Number: 5,577,608

[45] Date of Patent: Nov. 26, 1996

[54] PROTECTIVE COVER FOR PALLETIZED MATERIALS AND METHOD

[75] Inventors: Charles R. Hanson, Appleton; Joseph A. Kromholz, Milwaukee, both of Wis.

[73] Assignee: Great Northern Corporation, Appleton, Wis.

[21] Appl. No.: 512,380

[22] Filed: Aug. 7, 1995

[51] Int. Cl.[6] ..... B65D 81/02

[52] U.S. Cl. ..... 206/386; 206/586

[58] Field of Search ..... 206/453, 386, 206/521, 586, 821; 248/345.1

[56] References Cited

U.S. PATENT DOCUMENTS 4,883,179 11/1989 Dionne ..... 206/586 X
5,139,145 8/1992 Cook ..... 206/586 X

OTHER PUBLICATIONS

VBOARD Your Competitive Edge–Product Brochure.

*Primary Examiner*—Jacob K. Ackun
*Attorney, Agent, or Firm*—Wheeler Kromholz & Manion

[57] ABSTRACT

An improved protective cover for palletized materials and a method for constructing and using the same. The protective cover is formed from two members, each having a substantially "L" shaped cross section comprising two legs or margins which meet at an edge. Material is removed from a portion of one margin of each member forming a notch in that margin. A crease is formed in the opposite margin of each member adjacent the notch. The members are pivotally connected near their ends with connectors. The connected members pivot at the connections and fold at the creases to form a substantially rectangular protective cover to be placed over a palletized stack of materials.

9 Claims, 10 Drawing Sheets

PROTECTIVE COVER FOR PALLETIZED MATERIALS AND METHOD

BACKGROUND OF THE INVENTION

Cartons or containers are used in many industries for the packaging and shipping of products. Cartons are typically stacked on pallets or palletized so that they can be easily transported in groups in warehouses, into and out of semi-truck trailers, etc. Typically, more than one carton is placed on each pallet and the cartons are stacked in layers one on top of the other. The height of the stacked cartons on each pallet depends upon the size of each carton, the contents of each carton, and special shipping requirements.

Besides stacking one carton on top of another on each pallet, pallets are often stacked on top of one another. When stacking a first pallet of palletized cartons on top of another, load failure often occurs when a carton is dislodged or collapses on the lower pallet. Furthermore, during shipping, vibration and load shifting can easily cause a carton to dislodge or collapse and cause other palletized cartons above it to fall. In both situations, the contents of the cartons are often damaged or destroyed.

There are inherent weaknesses with known carton stacking systems. While the bottom layer of cartons all rest on the pallet and thus are held together on this commonly shared surface, the top layer of cartons is not interconnected. Each stack of cartons often resembles a stack of blocks that can easily topple or fall if not secured.

If a second pallet is stacked on top of the first palletized group of cartons, there is no edge protection for the top layer of cartons upon which the second pallet is placed. If the second pallet should contact the edges of the top layer of cartons during stacking with a sufficient force, the carton edges and sides are typically damaged. Because most cartons rely on their edges and sides for a majority of their structural strength, once damaged the cartons may be incapable of supporting one or more palletized loads.

Further, many devices designed to provide edge protection for palletized groups of cartons or other work pieces are fastened together with fasteners like rivets, which have the star burst side of the rivet or fastening device directed toward the product that is to be protected. This can sometimes cause the product to be marred or adversely affected by the pallet protector itself since these fasteners are usually made of a sturdy material like metal or plastic which can then catch on the material that is being protected; e.g., paper goods.

When the ends of a protective cover like the one disclosed herein are fastened together the members of the protective cover are usually symmetrical, i.e., identical in shape, such that when positioned to protect the edge of the top layer of work pieces or cartons on a pallet a gap is presented at at least two corners on a pallet having a substantially square or rectangular shape. Reducing the size of this gap would increase the protection for the palletized products.

Additionally, the protective members disclosed herein are usually designed with a crease wherein the protective members may be bent at the crease so that they are capable of protecting at least two sides of the upper edge of the top layer of cartons or other palletized material. Prior art devices have always had a crease such that the point of the crease is spatially oriented in a direction away from the palletized material. This type of crease structure has a tendency to crack or split over time. Accordingly it is an objective of the present invention to provide a protective cover for palletized material wherein the crease is less likely to crack or split when in use.

The inventors know of no other prior art which either teaches or shows the present invention.

SUMMARY OF THE INVENTION

The invention comprises a protective cover for palletized materials. Its principle components include a pair of members, each member having a substantially "L" shaped profile, and a pair of connectors.

Each "L" shaped member has a first margin and a second margin. The margins meet at a substantially right angle. Each member has a predetermined length. To produce a rectangular protective cover, the length of each member is equivalent.

In my preferred embodiment, the members are constructed from a laminated paper composite. Strips of paper are glued together, bent at substantially a right angle along the longitudinal axis of the strips, and placed under pressure until the glue has dried thus giving each member its rigidity. Alternatively, my invention could be manufactured from any other suitable material.

On the first margin of each member, a notch of material having an apex is removed. In the preferred embodiment, the notch is triangular in shape. A crease is formed on the opposite margin of the "L" shaped member. The crease begins at the apex of the notch and extends to the opposite edge of the member. The crease has a radius. In the preferred embodiment, the crease is radiused toward the inside of each member. This minimizes ply breaking when the protective cover is opened.

Openings are formed near the ends of each member. The first member is placed on top of the second member such that the margins having the notches are parallel and resting one on top of the other. The opposite margins having the creases are spaced a predetermined distance apart. In one embodiment, the first member has a portion of both its first and second end that is non-symmetrical to the first end and the second end of the second member. The first and second end of the first member may or may not be symmetrical to each other. Furthermore, the ends may be arcuate in shape In another embodiment, the width of the first member is greater than or less than the width of the second member. Alternatively, the end portion of the first member may have a maximum width equal to the width of the second member and the width of each end portion of the first member gradually decreasing from the maximum to a predetermined minimum width.

The respective openings near the ends of each member are aligned and a connector or fastener is passed through each pair of openings. The fastener has a smooth head surface which is oriented toward the palletized products over which the protective cover is installed. This minimizes the potential for damage to the palletized products caused by the fastener.

When the resulting structure is grasped at the creases in the opposite margins and pulled outward, the members fold at the margins, pivot at the connections and the protective cover is formed. The cover is substantially rectangular in shape and sized to fit over a palletized group of cartons, on the side of a palletized group of cartons, or between a bottom layer of palletized group of cartons and the top surface of a skid.

Alternatively, my invention could be described as a method for protecting palletized materials using an improved cover for palletized materials, the protective cover including a first member and a second member; each said member having a substantially L shaped profile; each said member including a notch and having a first end and a second end; said members being coupled to each other at said first end and said second end, the method comprising: connecting the first ends of each member and connecting the second ends of each member to form the improved cover, opening the improved cover, and placing the improved cover over the palletized materials.

Because my invention is not permanently attached to the edges of the palletized cartons, it is fully reusable.

DETAILED DESCRIPTION

Figure 1:
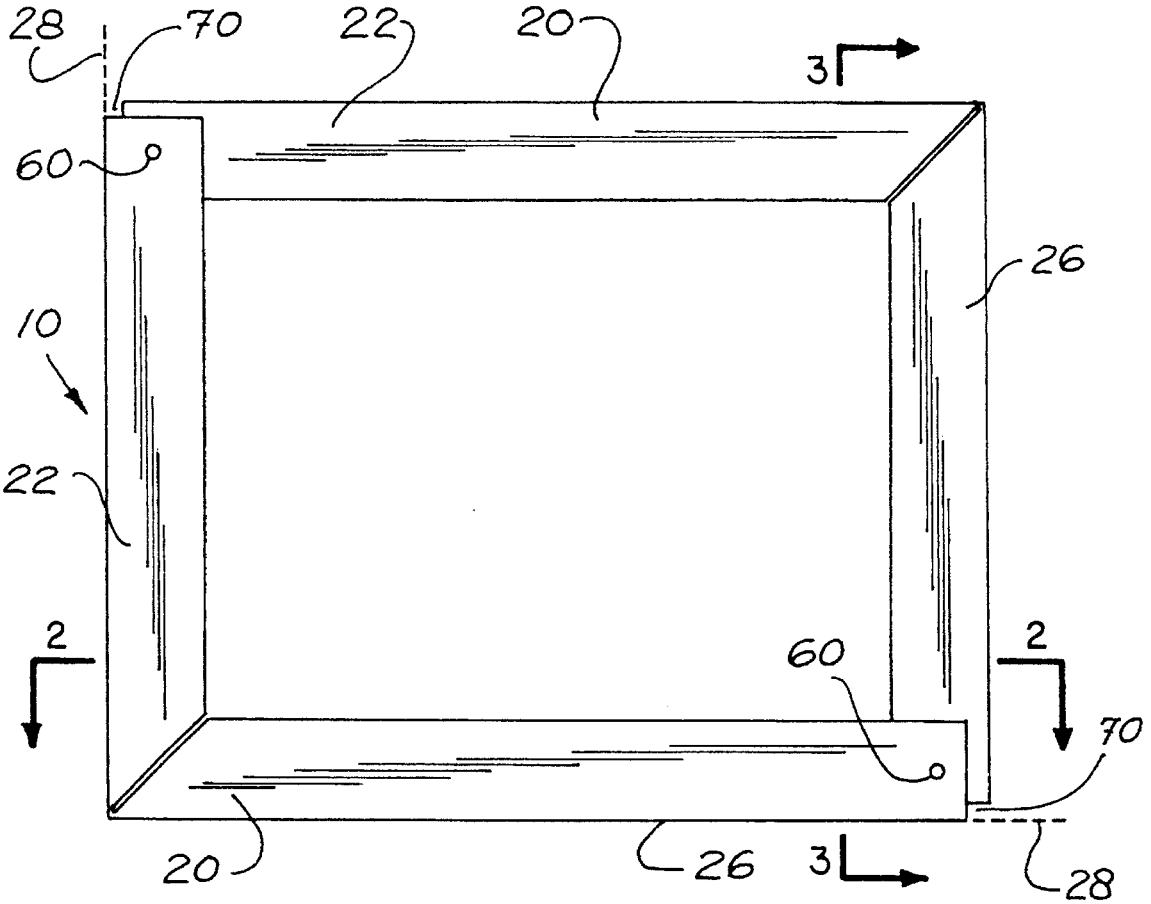
FIG. 1 is a top plan view of a first embodiment of the present invention.
Figure 2:
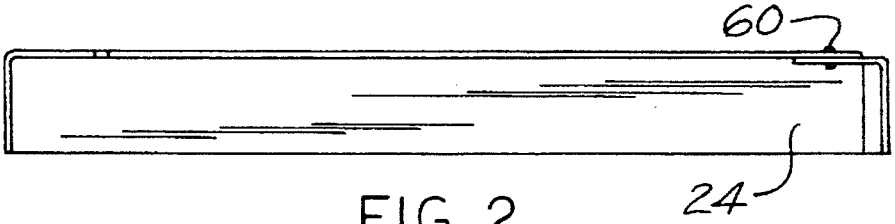
FIG. 2 is a side elevational view of the structure of the first embodiment taken from line 2—2 of FIG. 1.
Figure 3:
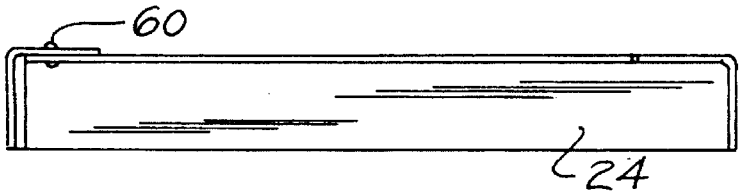
FIG. 3 is a side elevational view of the first embodiment taken from line 3—3 of FIG. 1.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

With reference to the drawings in general, and to FIGS. 1, 4, 12, 13 and 14 in particular, my improved protective cover for palletized materials is generally shown as 10.

The apparatus 10 is formed from a pair of members 20, each member 20 having a substantially "L" shaped cross section. Thus each member has a first leg or margin 22 and a second leg or margin 24. The margins 22 and 24 meet at substantially a right angle to form a corner or edge 26. Each leg or margin 22 and 24 is approximately 2½ inches (6.35 centimeters) wide.

The invention 10 is preferably manufactured from sheets of paper laminated together with glue or another suitable adhesive. The glue is applied between the sheets of paper. The resulting composite is then bent at substantially a right angle along its longitudinal axis 28 and pressure is applied to the member 20 until the glue has dried and the rigid structure has formed.

The length of each member 20 is approximately equal to the sum of the length and width of the stack of palletized cartons to which the apparatus 10 is installed.

Figure 18:
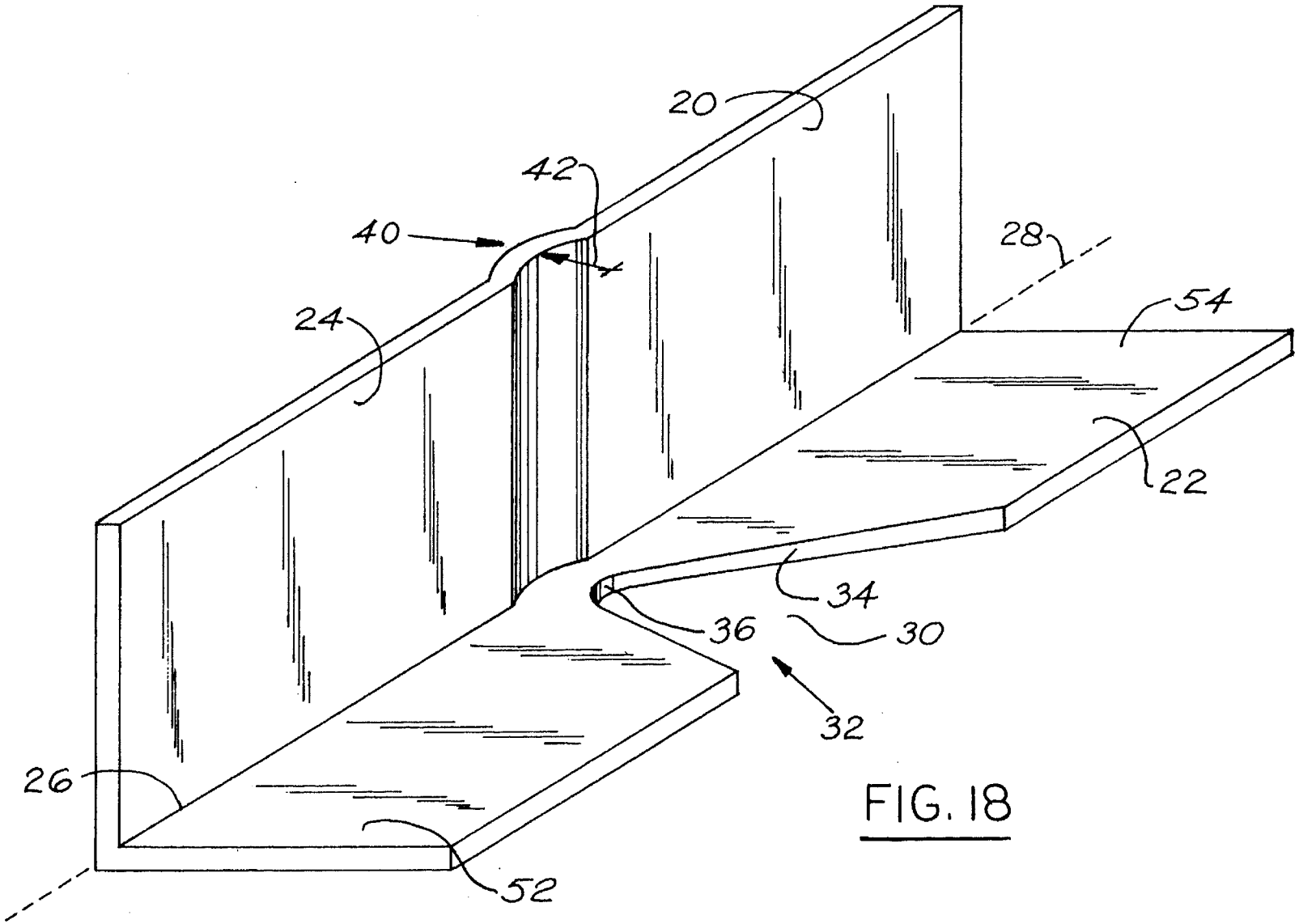
FIG. 18 is a perspective view of an alternative embodiment of a member of the present invention.
Figure 19:
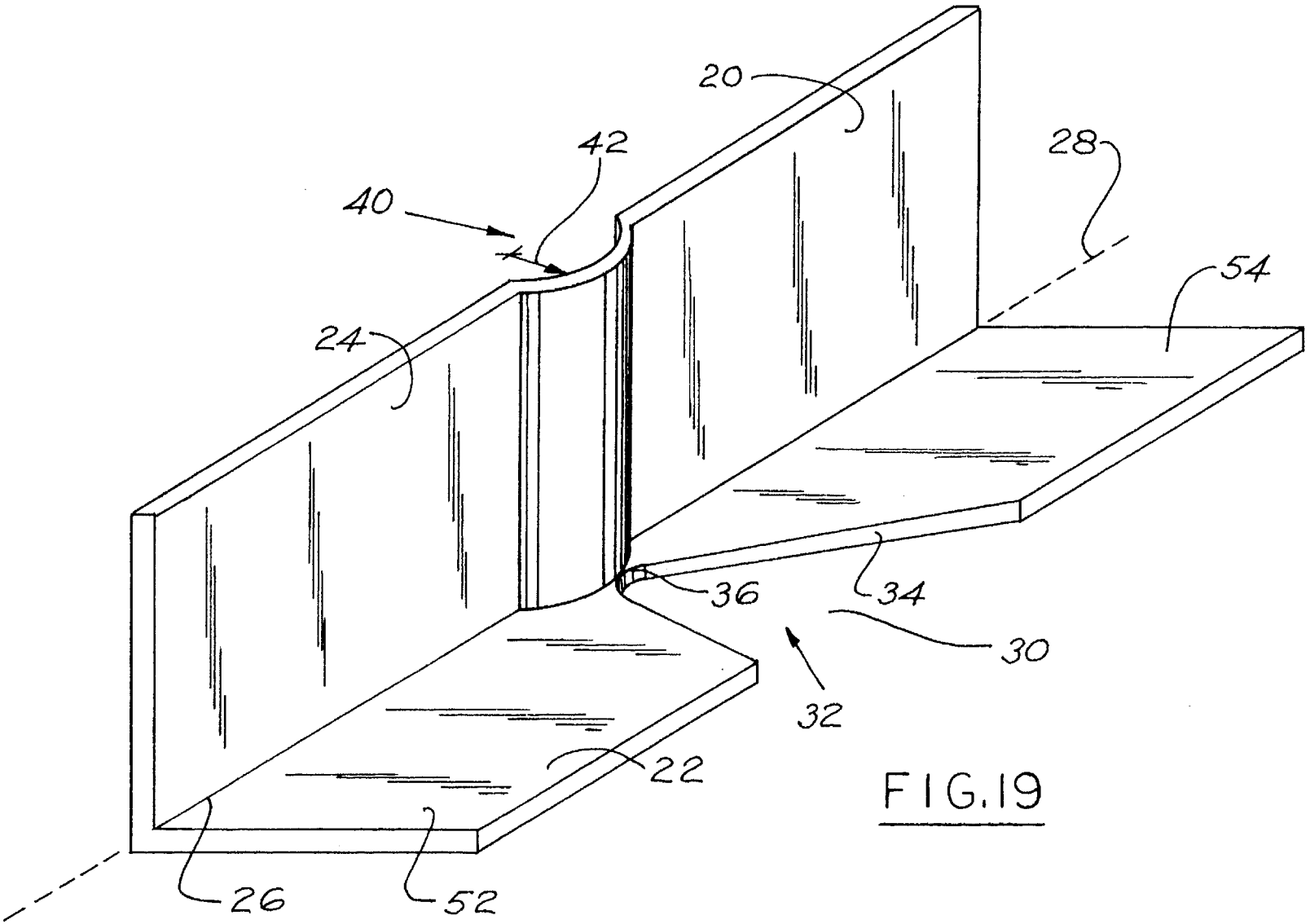
FIG. 19 is a perspective view of a member of the perspective invention.

On each member 20, material is removed from a predetermined portion 30 of margin 22 forming a notch 32 as shown in FIGS. 18 and 19. The remaining edges 34 of margin 22 at notch 32 form a triangle whose apex 36 meets the edge 26 of margins 22 and 24. In the preferred embodiment, the apex 36 in edges 34 forms a right angle.

As shown in FIGS. 18 and 19, a crease 40 is formed in the opposite margin 24. The crease has a radius 42. In the preferred embodiment shown in FIG. 19, the radius 42 extends inward toward margin 22. This minimizes ply or laminated material breakage when the protective cover 10 is subsequently formed. Alternatively, the radius 42 could extend outward as shown in FIG. 18. However, this can cause the outer plys of the laminated material to break when the protective cover 10 is formed.

Figures 15, 16:
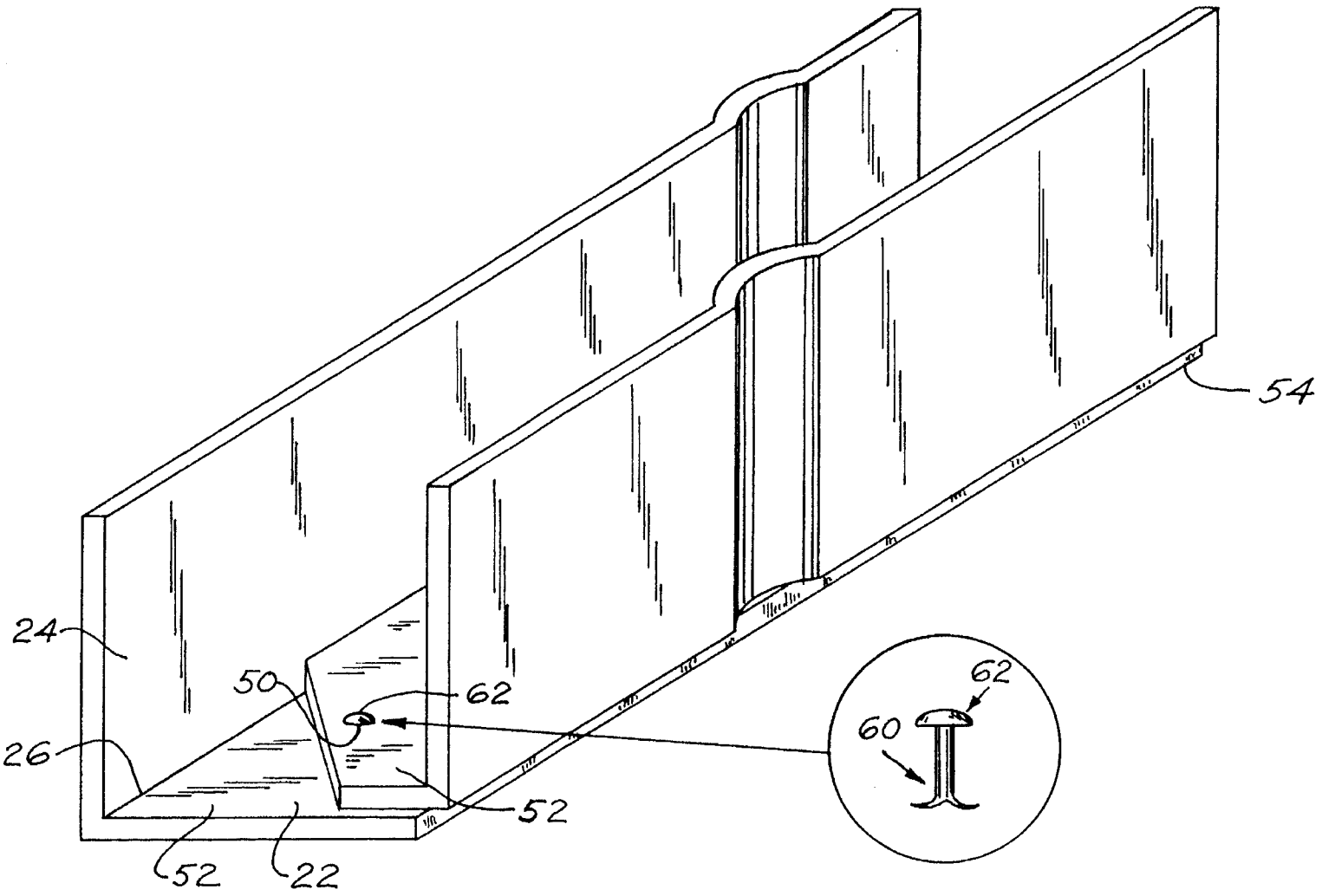
FIG. 15 is a perspective view of an alternative embodiment of the present invention.
FIG. 16 is a side elevational view of a fastener for fastening the ends of the members of the present invention to one another.
Figure 17:
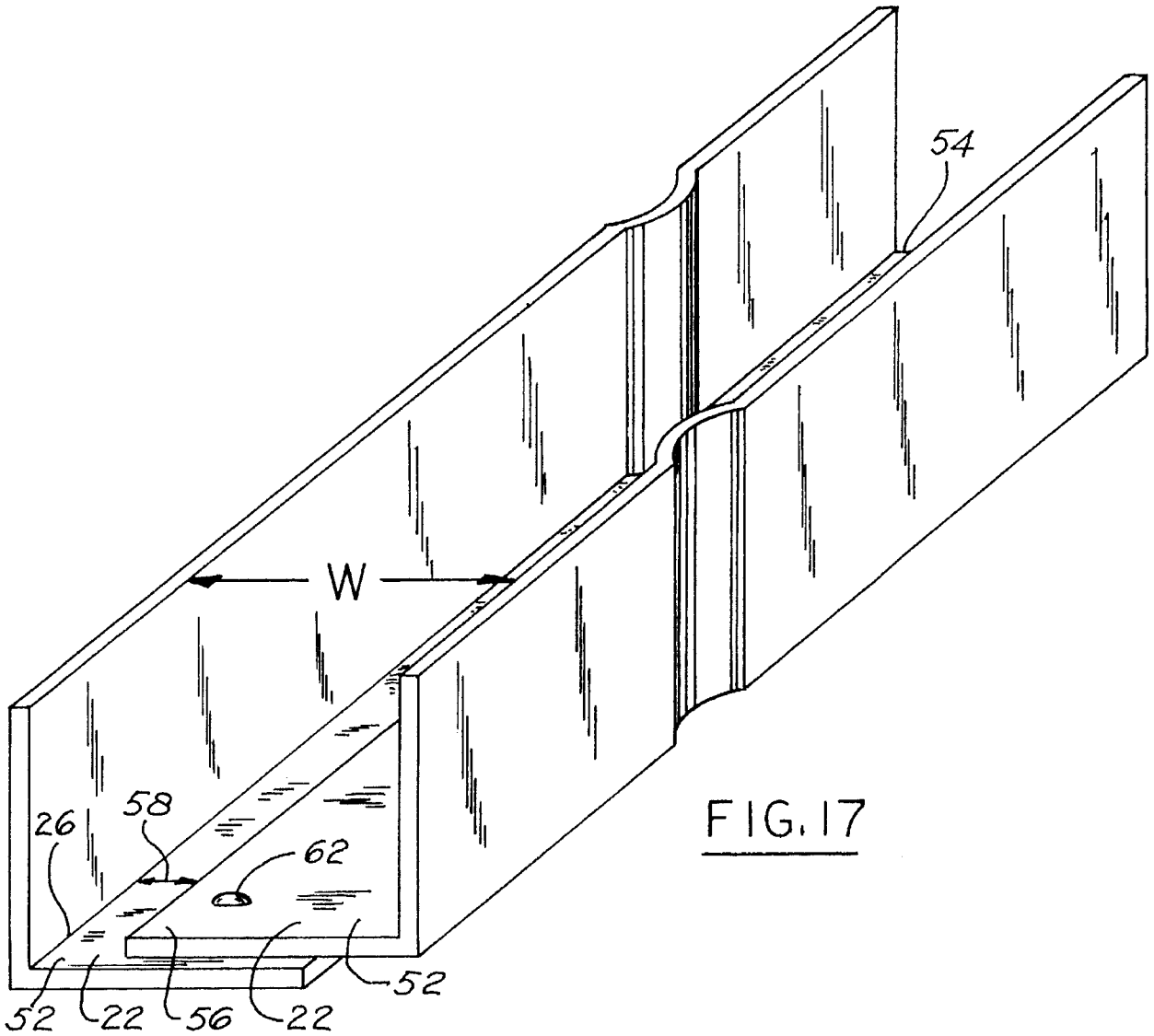
FIG. 17 is a perspective view of another alterative embodiment of the present invention.

As shown in FIGS. 15 and 17, an opening or aperture 50 is formed near the ends 52 and 54 of each member 20. The location of openings 50 and the distance "W" between the margins 24, as shown in FIG. 17, are critical so that the protective cover 10 can be opened to its rectangular shape without the corner 56 of margin 22 striking the edge 26 or margin 24.

In the first embodiment shown in FIG. 17, openings 50 are formed in margins 22 of each member 20 and margins 24 are spaced apart a predetermined distance "W" to allow the assembled protective cover 10 to be opened without corner 56 striking margin 24 when the protective cover 10 is opened. The dimension "W" must be great enough so that a predetermined gap 58 exists between the edge 23 of margin 22 and corner 26 of member 20. The edge 23 of margin 22 cannot rest against the inside of corner 26. If it does, the assembled structure 10 cannot be opened. A drawback of this structure is shown in FIG. 1. At least two corners 70 of protective cover 10 formed at the connections will be open. Complete closure of the corners 70 cannot be achieved.

Figure 4:
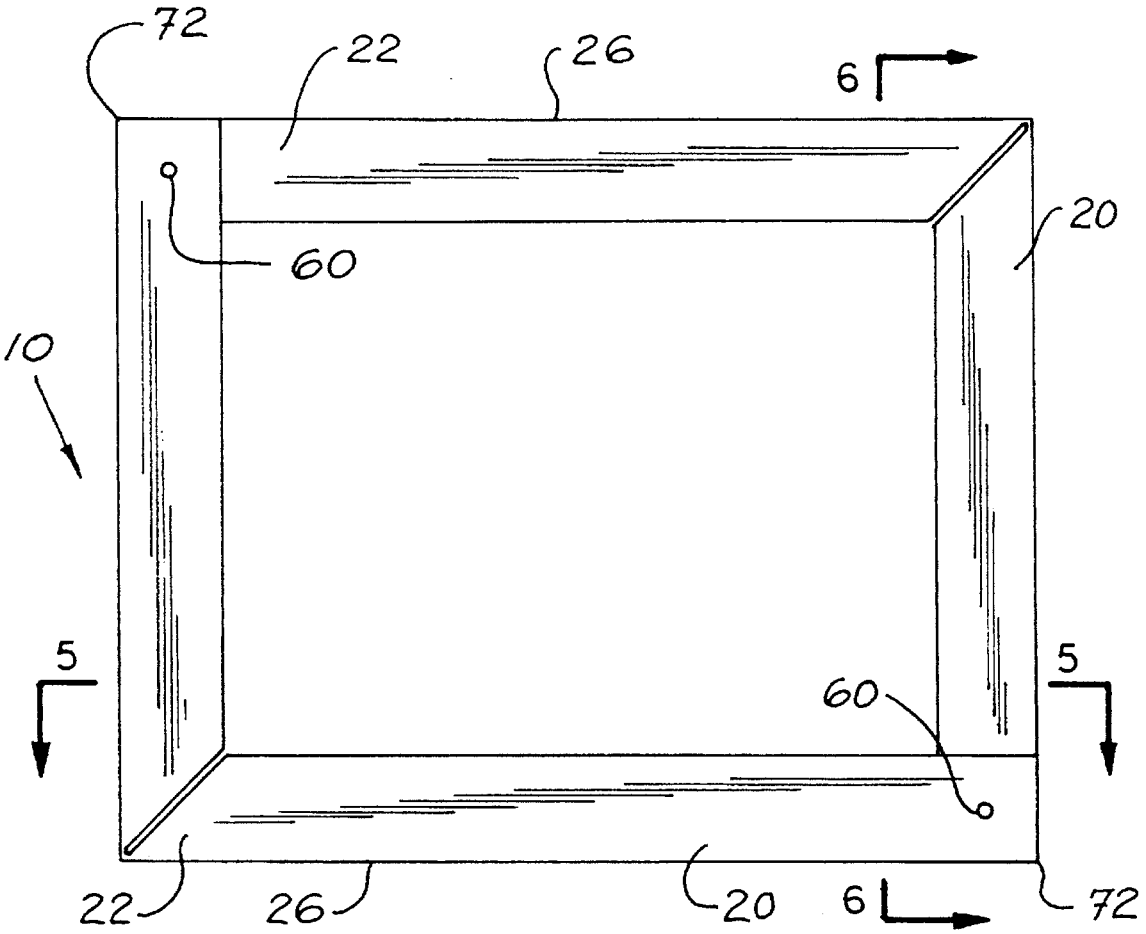
FIG. 4 is a top plan view of an alternative embodiment of the present invention.
Figure 5:
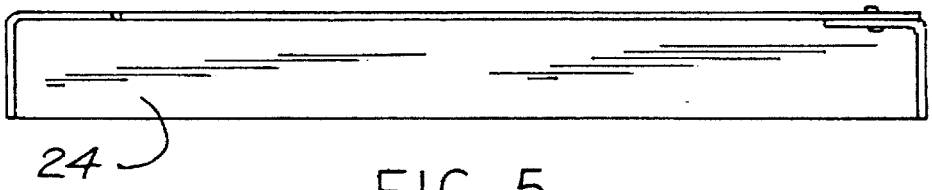
FIG. 5 is a side elevational view from line 5—5 of FIG. 4.
Figure 6:
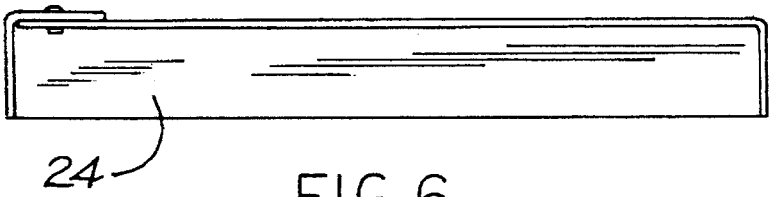
FIG. 6 is a side elevational view taken from line 6—6 of FIG. 4.
Figure 7:
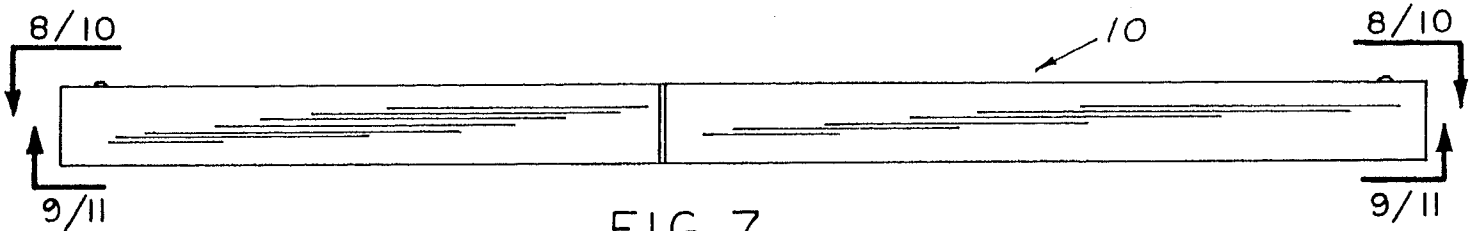
FIG. 7 is a side elevational view of the first and alternative embodiments showing the invention in a collapsed state.
Figure 8:
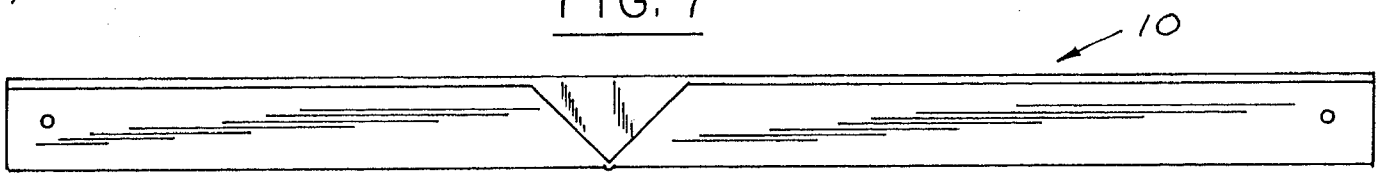
FIG. 8 is a top plan view of the first embodiment in a collapsed state taken from line 8—8 of FIG. 7.
Figure 9:
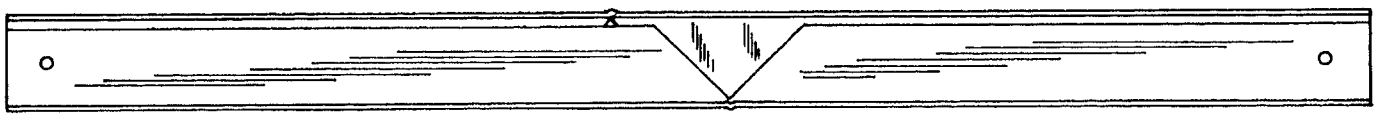
FIG. 9 is a bottom plan view of the first embodiment in a collapsed state taken from line 9—9 of FIG. 7.
Figure 10:
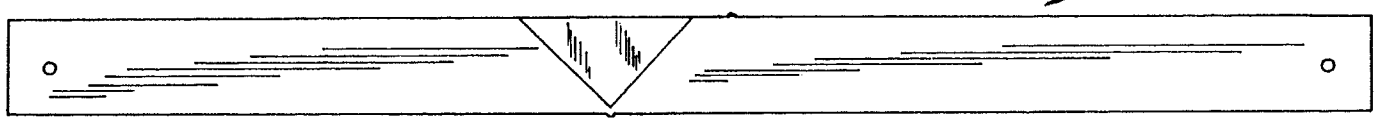
FIG. 10 is a top plan view of an alternative embodiment in a collapsed state taken from line 10—10 of FIG. 7.
Figure 11:
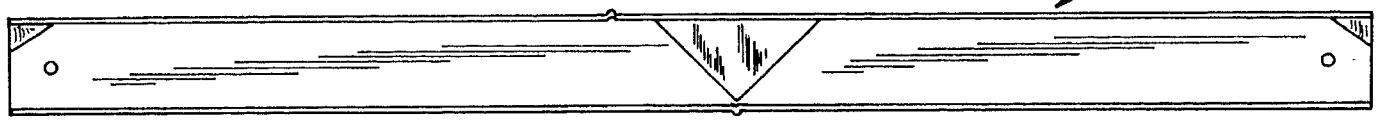
FIG. 11 is a bottom plan view of an alternative embodiment in a collapsed state taken from line 11—11 of FIG. 7.

In an alternative embodiment shown in FIG. 15, corner 56 is removed from margin 22. Edge 23 of margin 22 can be placed against margin 24 and the assembled structure 10 can still be opened. The predetermined distance between the margins 24 of the connected members 20 is decreased. Comparing FIGS. 1 and 4, the open corners 70 of the first embodiment shown in FIG. 1 are eliminated in the alternative embodiment. The resulting corners 72 of the alternative embodiment are closed as shown in FIG. 4.

The members 20 are placed one on top of the other, as shown in FIGS. 15 and 17, such that their margins 22 rest one on top of the other, openings 50 are in alignment, and margins 24 are spaced a predetermined distance "W" apart. A rivet or connector 60, shown in FIG. 16, is passed through the openings 50 in each member 20 near each member end 52 and 54. The rivet 60 has a smooth head 62 which is placed so that the head 62 contacts the tops of the cartons over which the protective cover 10 is installed.

After assembly of members 20 to each other with connectors 60, margins 24 of the respective members 20 are simply grasped and pulled apart. The margins 24 fold at their creases 40, edges 34 of notch 32 come together, and the rectangular protective cover 10 is formed. Once formed, the cover 10 can be placed on the top of a palletized load of cartons 12 as shown in FIG. 12, between the top surface of a skid and the bottom layer of a palletized load of cartons 12 as shown in FIG. 13, or on the side of a palletized load of cartons 12 as shown in FIG. 14.

Figure 12:
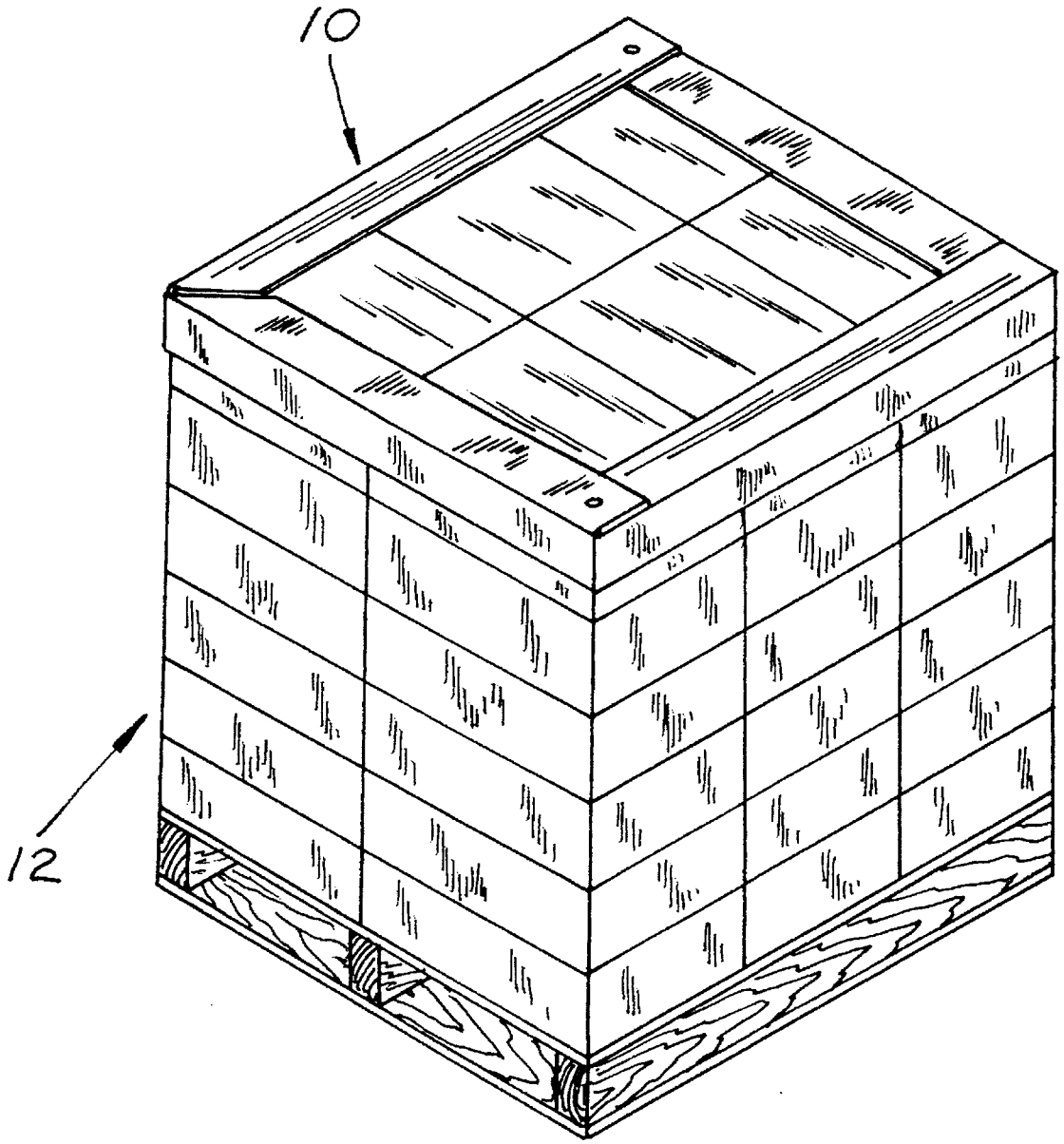
FIG. 12 is a perspective view showing the present invention in use on the top of a stack of cartons or work pieces stacked upon a pallet.

With respect to the use of the invention 10 as shown in FIG. 12, it provides edge protection to the top layer of cartons on the pallet. If a second palletized load is to be stacked on top of the first and the second pallet strikes the upper edge of the first pallet top layer, the location and structural integrity of the protective cover 10 prevents damage to the top layer of cartons.

When a second palletized load is placed on top of the first load, the protective cover provides a flat even surface for the second pallet.

Figure 13:
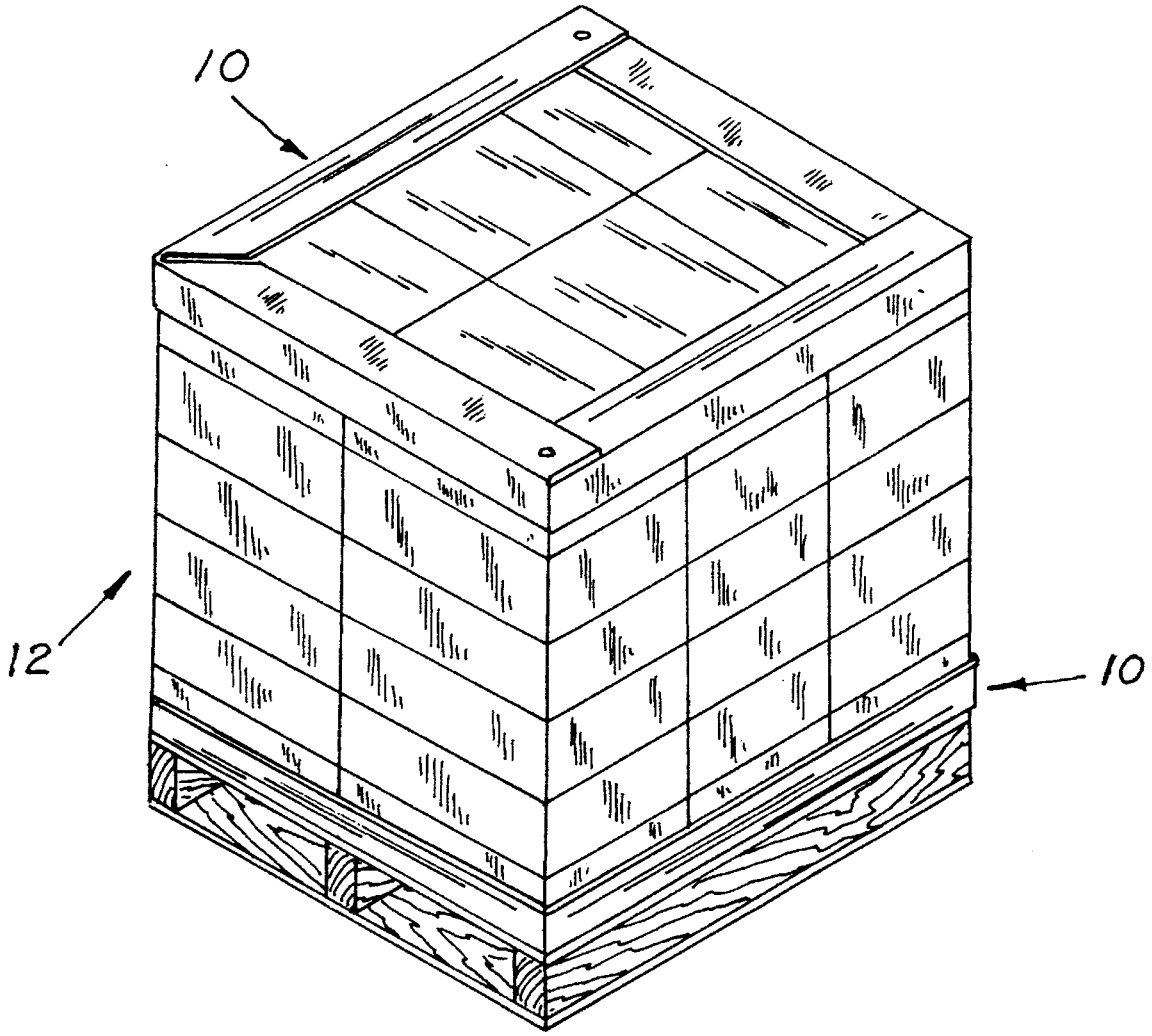
FIG. 13 is a perspective view showing the present invention in use on both the top and bottom of a stack of cartons or work pieces stacked upon a pallet.
Figure 14:
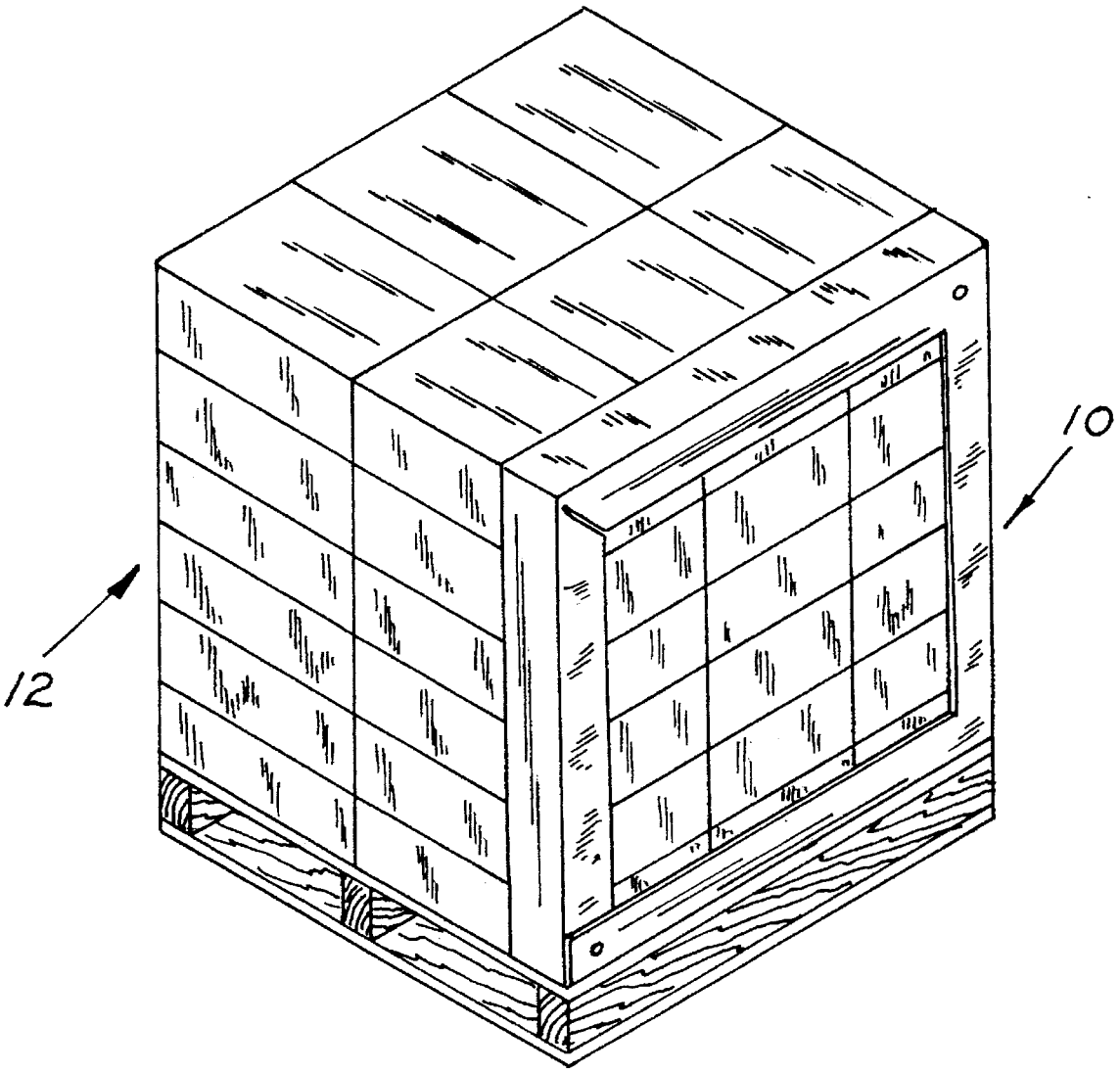
FIG. 14 is a perspective view showing the present invention in use on the side of a stack of cartons or work pieces stacked upon a pallet.

With respect to the application shown in FIG. 13, utilizing the invention 10 between the top surface of the skid and the bottom layer of cartons provides for better yet load containment. The invention 10 securely holds the bottom carton layer together as a group and eliminates the possibility of one or more bottom layer cartons from sliding off of the skid.

The application shown in FIG. 14 provides increased side edge protection as well as stacking protection. The previously exposed edges of the corner cartons are now protected by the members 20. Additionally, the members 20 provide for increased stacking strength when additional palletized loads are stacked on top of one another.

Because the protective cover 10 is not permanently attached to the edges of the palletized cartons 12 on each pallet, it is fully reusable. After removal, the protective cover 10 is simply collapsed as shown in FIGS. 7–11. In this compact state, the protective cover 10 can be easily stored for future use or shipped back to its origin for re-use.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An improved protective cover for palletized material, the protective cover including a first member and a second member; each member having a substantially L-shaped profile; each said member including a notch and having a first and a second end; said members being coupled to each other at said first end and said second end, the improvement comprising:

Said first member having a portion of both said first end and said second end non-symmetrical to the first end and the second end of the second member.

2. The improvement of claim one wherein the non-symmetrical first end and second ends are symmetrical to each other.

3. The improvement of claim 1 wherein the non-symmetrical first end and second end are arcuate in shape.

4. An improved protective cover for palletized material, the protective cover including a first member and a second member; each member having a substantially L-shaped profile; each said member including a notch and having a first and a second end; said members being coupled to each other at said first end and said second end, the improvement comprising:

said first member having a width and said second member having a width;

the width of the first member being narrower than the width of the second member.

5. The improved protective cover of claim number 4 wherein the first member has a first end portion and a second end portion each having a width narrower than the width of the second member.

6. The improved protective cover of claim number 5 wherein the width of each end portion of the first member has a maximum width equal to the width of the second member and the width of each end portion of the first member gradually decreases from the maximum width to a predetermined minimum width.

7. An improved protective cover for palletized material, the protective cover including a first member and a second member; each member having a substantially L-shaped profile; each said member including a notch and having a first and a second end; said members being coupled to each other at said first end and said second end, the improvement comprising:

said first member fastened to said second member by a fastener at said first end and said second end;

said first member and said second member each having a predetermined surface for being spatially orientated toward a product positioned on a pallet structure;

said fastener having a smooth surface adjacent to and substantially parallel to at least one said L-shaped member capable of contacting said product;

whereby the risk of damage to the product is substantially reduced.

8. The improvement of claim 7 wherein the fastener is a rivet having a smooth head.

9. An improved protective cover for palletized material, the protective cover including a first member and a second member; each member having a substantially L shaped profile; each said member including a notch and having a first and a second end; said members being coupled to each other at said first end and said second end, the improvement comprising:

said first member and said second member each having a crease substantially perpendicular to the notch such that the spatial orientation of said crease is directed toward said notch.

* * * * *